US005910191A

United States Patent [19]

Okamoto

[11] Patent Number: 5,910,191

[45] Date of Patent: Jun. 8, 1999

[54] SHIFTING MECHANISM FOR OUTBOARD MOTOR

[75] Inventor: Yutaka Okamoto, Shizuoka, Japan

[73] Assignee: Sanshin Kogyo Kabushiki Kaisha, Japan

[21] Appl. No.: 08/741,050

[22] Filed: Oct. 30, 1996

[30] Foreign Application Priority Data

Oct. 30, 1995 [JP] Japan ..... 7-281595

[51] Int. Cl.[6] ..... G05G 11/00; B63H 21/21

[52] U.S. Cl. ..... 74/473.14; 74/473.12; 74/473.3; 74/480 B; 440/86

[58] Field of Search ..... 74/473 R, 480 B; 440/86, 75, 900; 123/195 P, 196 W

[56] References Cited

U.S. PATENT DOCUMENTS

| | | | |
|---|---|---|---|
| 4,527,441 | 7/1985 | Nakahama . | |
| 4,802,871 | 2/1989 | Watanabe et al. | 440/75 |
| 4,963,109 | 10/1990 | Hayasaka . | |
| 5,000,708 | 3/1991 | Kawai et al. | 440/75 |
| 5,050,461 | 9/1991 | Onoue et al. . | |
| 5,076,113 | 12/1991 | Hayasaka . | |
| 5,094,122 | 3/1992 | Okita | 74/480 B |
| 5,486,125 | 1/1996 | Soda et al. | 440/75 |
| 5,553,586 | 9/1996 | Koishikawa et al. | 440/900 X |
| 5,687,688 | 11/1997 | Tsunoda et al. | 123/196 W |
| 5,694,895 | 12/1997 | Tsunoda et al. | 123/195 P |

FOREIGN PATENT DOCUMENTS

| | | | |
|---|---|---|---|
| 696895 | 10/1964 | Canada | 440/75 |

*Primary Examiner*—Rodney H. Bonck
*Assistant Examiner*—William C Joyce
*Attorney, Agent, or Firm*—Knobbe, Martens, Olson, & Bear, LLP

[57] ABSTRACT

An engine of an outboard motor includes an improved engine component layout to minimize the size of the engine and to generally isolate a shift position mechanism from an intake air flow into the engine. The outboard motor includes a shifting mechanism that shifts a transmission between three operational states: forward, neutral, and reverse. The shifting position mechanism is principally positioned directly beneath a flywheel of the engine. This position simplifies the design of the shifting mechanism and reduces the girth of the engine and associated components within the cowling.

32 Claims, 8 Drawing Sheets

SHIFTING MECHANISM FOR OUTBOARD MOTOR

BACKGROUND OF THE INVENTION

1. Field of the Invention

The present invention relates to an outboard motor, and in particular to a shift linkage mechanism for an outboard motor.

2. Description of Related Art

Outboard motors recently have become equipped with four-cycle engines. The use of four-cycle engine in the power head of the outboard motor, however, raises some formidable challenges in regard to the engine layout and arrangement within the protective engine cowling.

Prior four-cycle engines commonly include a large crankcase, and thus larger sizes, as compared with two-cycle engines. A larger engine also results because a four-cycle engine requires an oil pan. As a result, prior engine designs have struggled to provide sufficient space within the cowling in which to position many of the outboard motor components, including a shifting mechanism which controls a transmission of the outboard motor.

In prior four-cycle engine layouts, the shift linkage mechanism commonly lies to the side of the engine, near an air intake into an induction system of the engine. This location of the shifting mechanism and exposes the mechanism has resulted in an overly complicated mechanism. The increased number of parts and the complexity of the assembly may lead to assembly errors and to an increased possibility of malfunction.

In addition, the location of the shifting mechanism on the side of the engine tends to increase the size of the power head of the outboard motor. The power head generally extends above the transom of the watercraft and, as a result, the power head produces aerodynamic drag on the watercraft as the watercraft speeds over the water. The size and shape of the power head directly affect the amount of drag produced. The larger sized power head, which results from the prior layout of the shift actuation mechanism, thus negatively increases the drag experienced by the associated watercraft.

SUMMARY OF THE INVENTION

The present shifting mechanism involves a simply-structured system which is arranged within the engine compartment of the power head in a compact manner. The shifting mechanism is particularly well suited for use with outboard motor engines where an output shaft of the engine drives a flywheel positioned on the lower side of the engine.

One aspect of the present invention thus involves an outboard motor comprising an engine. The engine includes an output shaft which rotates about a vertical-extending axis and a flywheel carried on a lower section of the output shaft at a lower end of the engine. The output shaft drives a propulsion device through a transmission which is intended to operate under at least two operational conditions. A shift actuator cooperates with the transmission to selectively establish one of said two operational conditions of the transmission, and a shifting mechanism controls the shift actuator. The shifting mechanism is positioned below the level of the flywheel.

Another aspect of the present invention involves an outboard motor comprising an engine housed within a cowling. An output shaft of the engine extends at least from a lower end of the engine and is arranged to rotate about a vertically-extending axis. A flywheel is mounted to the output shaft at the lower end of the engine. A drive shaft is coupled to the output shaft and drives a propulsion system of the outboard motor through a transmission. The transmission establishes at least two drive conditions for the propulsion device. A transmission actuator cooperates with the transmission to establish one of said two drive conditions. Means are provided for operating the transmission actuator. These means are remotely located from said transmission actuator in a position lying at least partially beneath the flywheel.

BRIEF DESCRIPTION OF THE DRAWINGS

These and other features of the invention will now be described with reference to the drawings of preferred embodiments of the present shifting mechanism incorporated into an outboard motor engine. The illustrated embodiments of the shifting mechanism are intended to illustrate the invention, but not to limit it. The drawings contain the following figures.

DETAILED DESCRIPTION OF PREFERRED EMBODIMENTS OF THE INVENTION

Figure 1:
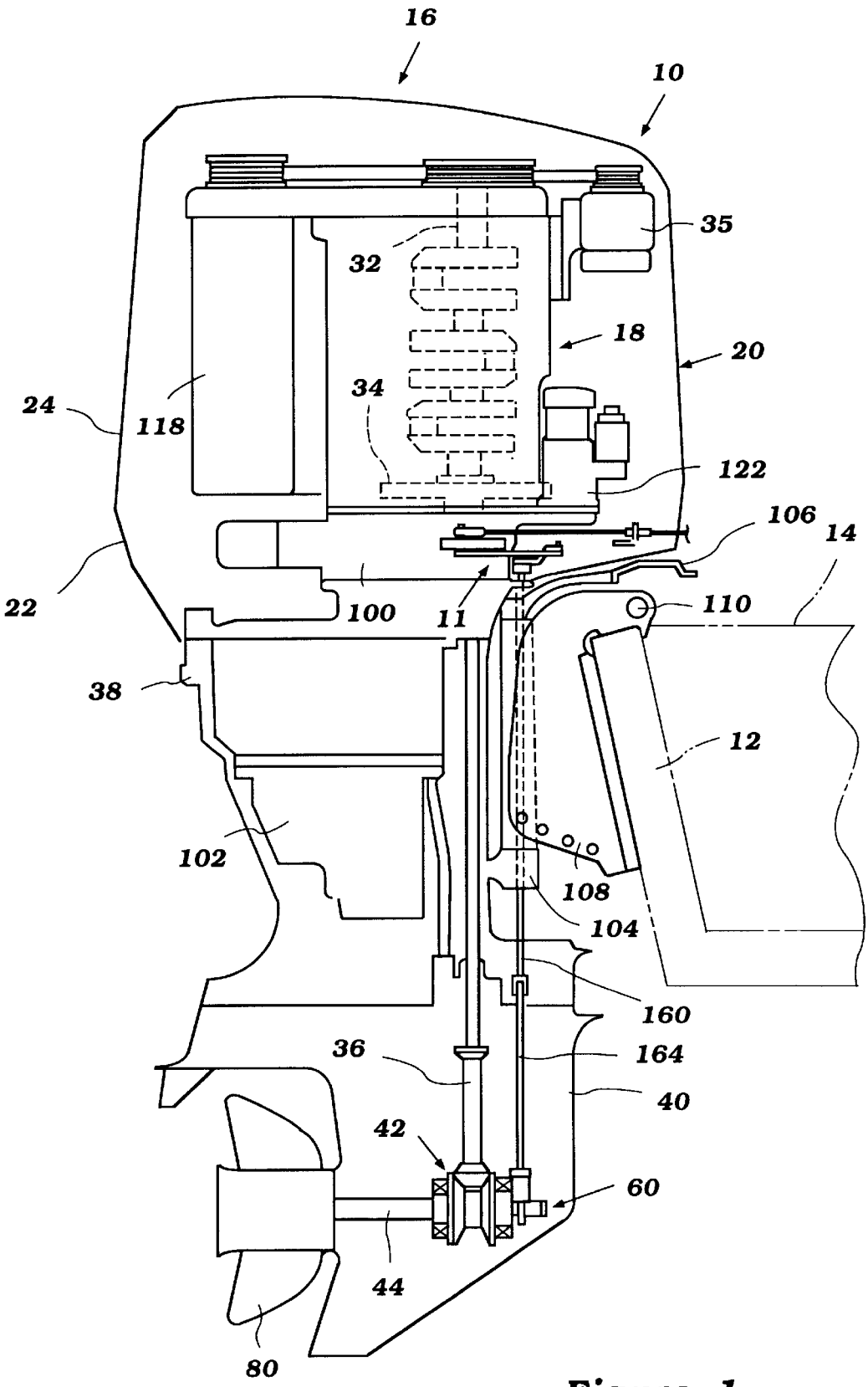
FIG. 1 is a side elevational view of an engine, a drive train and an associated shifting mechanism of an outboard motor with the housings of the outboard motor shown in outline and shown attached to a transom of a watercraft by a clamp mechanism.

FIG. 1 illustrates an outboard motor 10 which incorporates a shifting mechanism 11 configured and arranged in accordance with the preferred embodiment of the present invention. In the illustrated embodiment, the outboard drive 10 is depicted as an outboard motor for mounting on a transom 12 at the stem of a watercraft 14. It is contemplated, however, the present shifting mechanism 11 can be incorporated with other types of marine drives as well.

In order to facilitate the description of the present shifting mechanism 11 and its arrangement within the outboard motor 10, the terms "front" and "rear" are used to indicate positions of the outboard motor components relative to a fixed datum: the transom 12 of the watercraft 16. Thus, as used herein, "front" refers to a position or side closer to the watercraft transom 12, and "rear" refers to a position or side distanced from the transom 12.

Figure 2:
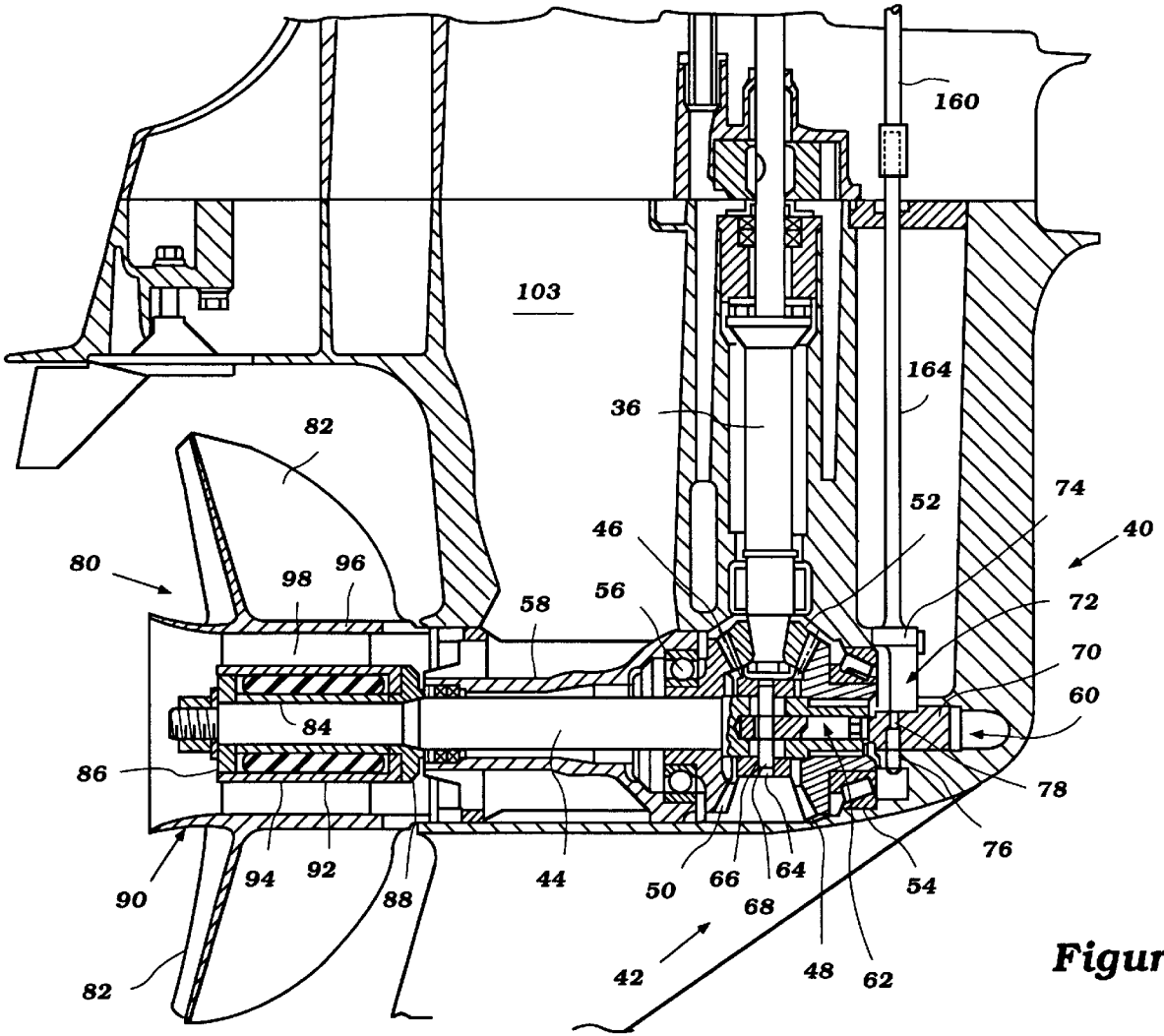
FIG. 2 is a cross-sectional view of a transmission of the drive train and a lower unit of the outboard motor of FIG. 1.

With initial reference to FIGS. 1 and 2, the outboard motor 10 has a power head 16 which includes an internal combustion engine 18. Because the present shifting mechanism 11 has particular utility with a four-cycle engine, the present shifting mechanism 11 will be described in connection with such an engine; however, the depiction of the engine in conjunction with a four-cycle, in-line, multi-cylinder combustion engine is merely exemplary. Those skilled in the art will readily appreciate that the invention may be employed with engines having other numbers of cylinders, having other numbers of cylinder arrangements or orientations (e.g., V-type or slant), and/or operating on other than a four-stroke principle (e.g., on a two-cycle principle).

A protective cowling assembly 20 surrounds the engine. The cowling assembly 20 includes a lower tray 22 and a top cowling 24. The tray 22 and cowling 24 together define a compartment which houses the engine 18 with the lower tray 22 encircles a lower portion of the engine 18.

Figure 6:
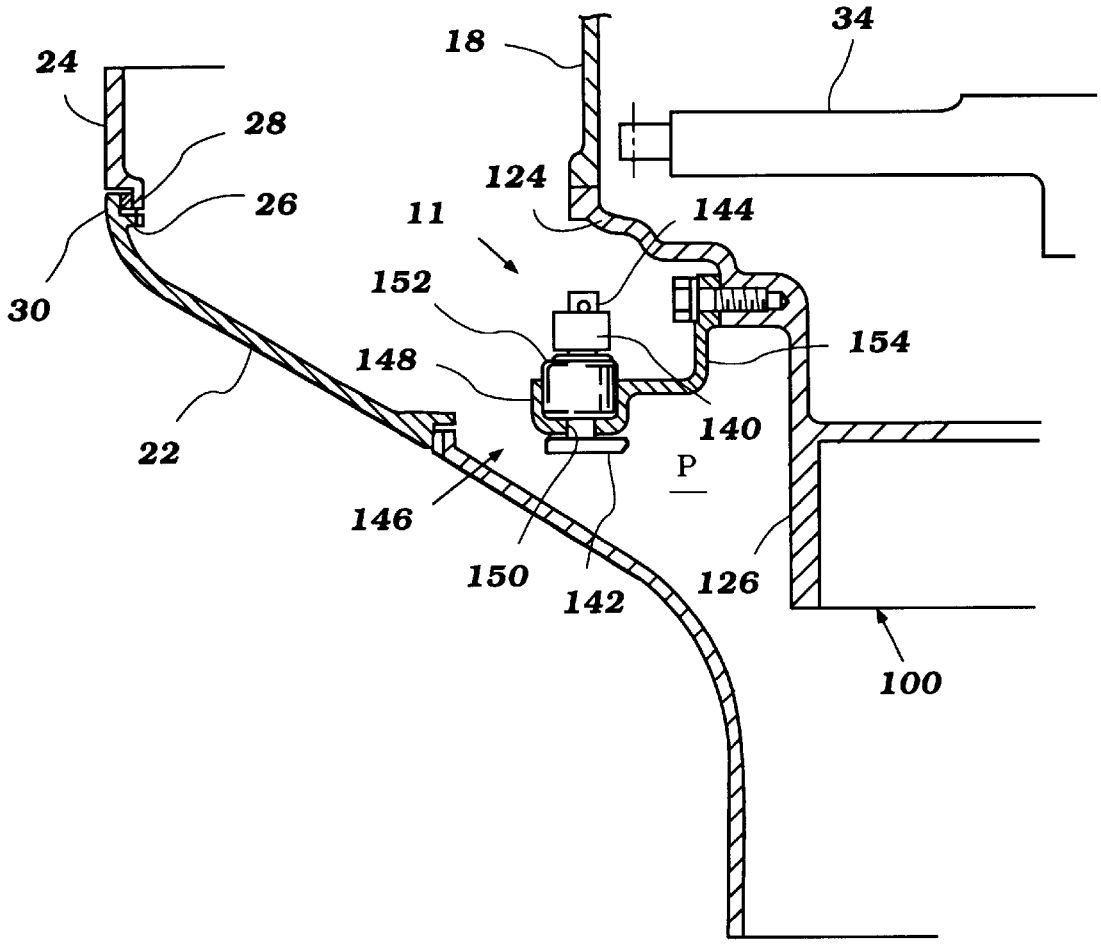
FIG. 6 is a partial cross-sectional, side elevational view of the shifting mechanism attached to the engine as viewed in the direction C—C of FIG. 4.

As best seen in FIG. 6, the lower tray 22 defines a seat 26 around its inner periphery in which a lower edge 28 of the top cowling 24 sits. A sealing gasket 30 seals the junction between the lower tray 22 and the cowling 24 to inhibit water flow into the engine compartment.

With reference back to FIG. 1, the engine 18 is supported within the power head 16 so that its output shaft 32 (e.g., crankshaft) rotates about a generally vertical axis. In the illustrated embodiment, the crankshaft 32 carries a flywheel assembly 34 on a lower section of the shaft 32 at a lower end of the engine 18. The upper end of the crankshaft 32 drives a crankshaft pulley at an upper end the engine. The pulley drives a timing belt, as well as an alternator 35 through known means.

The crankshaft 32 also drives a drive shaft 36 (see FIG. 2) which depends from the power head 16 and rotates about the generally vertical axis. The drive shaft 36 extends through a drive shaft housing 38 and is suitably journaled therein for rotating about the vertical axis. As seen in FIG. 1, the drive shaft housing 38 extends from the lower tray 22 and terminates in the lower unit 40.

The drive shaft 36 continues into a lower unit 40 where it drives a transmission 42 through an input gear. The transmission 42 selectively couples the drive shaft 36 to a propulsion shaft 44. The transmission 42 advantageously is a forward/neutral/reverse-type transmission. In this manner the drive shaft 36 drives the propulsion shaft 44 in any of these operational states, as described below in detail.

In the illustrated embodiment, as seen in FIG. 2, the transmission 42 includes at least one dog clutch 46 which operates between a pair of driven gears 48, 50 (e.g., bevel gears). A pinion gear 52 carried at the lower end of the drive shaft 36 drives the driven gears 48, 50 in opposite directions.

The front driven gear 48 includes a hub portion that is journaled in the lower unit 40 by a thrust bearing assembly 54. The bearing assembly 54 supports the front driven gear 48 in mesh engagement with the pinion 52.

The rear driven gear similarly includes a hub portion. A rear bearing assembly 56 journals the hub within an enlarged end of a bearing carrier 58. The bearing carrier 58 is secured within the lower unit 40 by known means and surrounds a portion of the propulsion shaft 44 directly behind the transmission 42. The propulsion shaft 44 extends through and is journaled by the hub portions of the driven gears 48, 50 in a suitable manner.

The dog clutch element 46 is formed with internal splines that mate with corresponding external splines formed on the outer surface of the propulsion shaft 44. The splines establish a driving connection between the clutch element 46 and the propulsion shaft 44 while permitting the clutch element 46 to move axially relative to the propulsion shaft 44.

The clutch element 46 includes a first series of axially facing jaws that face forwardly and which are adapted of coact with jaws formed on the front driven gear 48. Coaction between the jaws of the clutch element 46 and the front gear 48 establish a driving relationship between the driven gear 48, the clutch element 46 and the propulsion shaft 44.

In a similar manner, the clutch element 46 includes a second series of rearwardly facing jaws that are adapted to cooperate with complementary clutch jaws on the rear driven gear 50. Engagement between the jaws of the clutch element 46 and the rear driven gear 50 establish a driving relationship between the driven gear 50, the clutch element 46 and the propulsion shaft 46.

A transmission actuator 60 moves the clutch element 46 between a forward position, in which the clutch engages the front bevel gear 48 to drive the propulsion shaft 44 in a forward direction, a neutral position, in which the clutch 46 is disengaged from the bevel gears 48, 50, and a rear position, in which the clutch 46 engages the rear bevel gear 50 to drive the propulsion shaft 44 in a reverse direction. In the illustrated embodiment, the transmission actuator 60 includes a plunger 62 that slides within a bore formed in the front end of the propulsion shaft 44. The plunger 62 includes a flared head and a cylindrical body. A reduced diameter cylindrical neck connects the flared head of the plunger 62 to the plunger body.

A pin 64 connects the plunger 62 to the clutch element 46. The pin 64 extends transversely through the plunger 62 with the ends of the pin 64 captured within a complementary bore through the clutch element 46.

The pin 64 also passes through an elongated slot 66 within the propulsion shaft 44. The slot 66 has an axial length at least equal to the travel of the clutch element 46 when moved between the forward position and the rear position.

An annular groove 68 circumscribes the exterior of the clutch element 46. The groove 68 is formed such that the ends of the bore through the clutch element 46 lie at the base of the groove 68. Although not illustrated, a coil spring, which is positioned within the groove 68, can retain the pin 64 within the bore of the clutch element 46.

A follower member 70 of the transmission actuator 60 reciprocates the plunger 62 to move the clutch element 46 between the forward and rear positions. The follower member 70 is slidably supported within a recess formed in the forward end of the lower unit 40. The follower member 70 includes an arcuate recess which receives the plunger's flared head. The reduced diameter portion of the plunger 62 extends through a recess in an upstanding end wall of the follower member 70. In this manner, the follower member 70 and the plunger 62 are coupled together for simultaneous axial movement, while permitting the plunger 62 to rotate relative to the follower member 70.

A cam member 72 cooperates with the follower member 70. The cam member 72 includes a cylindrical upper bearing portion 74 which is journaled in a complementary bore formed in the lower unit 40. An smaller diameter cylindrical bearing portion 76 is formed at the lowermost end of the cam member 72. This lower bearing portion 76 is journaled within a bore formed in the lower unit 40 below the follower recess 70.

A crank-shaped driving portion of the cam member 72 is formed between the upper and lower bearing portions 74, 76. The driving portion includes a drive pin 78 connected to the lower bearing portion 76. An upper arm portion connects the drive pin 78 to the upper bearing portion 74. The drive pin 78 is eccentrically positioned relative to the common rotational axis of the upper and lower bearing portions 74, 76.

The follower member 70 includes a pair of oppositely facing surfaces between which the pin 78 is received. In this manner, rotation of the eccentric pin 78 about the axis defined by the bearing portions 74, 76 effects axial movement of the follower member 70 for reciprocation of the plunger 62 between the forward and rear drive positions. The follower member 70 is formed with a clearance recess below its driving surfaces so as to clear the crank arm. In a like manner, the lower portion of the follower member 70 is formed with an elongated slot to permit reciprocation of the follower member 70 without the lower bearing portion 76 of the cam member 72 interfering with the travel of the follower member 70.

The propulsion shaft 44 can drive a variety of different types of propulsion devices 80, such as, for example, a propeller or a hydrodynamic jet. In the illustrated embodiment, the propulsion device 80 is a single propeller having a plurality of propeller blades 82; however, it is understood that a counter-rotating, dual-propeller propulsion device can be used as well.

As seen in FIG. 2, the propeller shaft 44 extends beyond the rear end of the bearing carrier 58. The rear end of the propulsion shaft 44 carries an engagement sleeve 84 that has a splined connection with the rear end of the propulsion shaft 44. The sleeve 84 is fixed to the propulsion shaft 44 between an annular retainer ring 86, which is secured to the shaft by a nut and washer threaded onto the rear end of the propulsion shaft 44, and a trust washer 88 that engages diameter step in the propulsion shaft 44 at a point near the rear end of the bearing carrier 58.

The propulsion shaft 44 also carries a first propeller boss 90. An elastic bushing 92 is interposed between the engagement sleeve 84 and the propeller boss 90 and is compressed therebetween. The bushing 92 is secured to the engagement sleeve 84 by a heat process known in the art. The frictional engagement between the boss 90, the elastic bushing 92, and the engagement sleeve 84 is sufficient to transmit rotational forces from the sleeve 84, driven by the propulsion shaft 44, to the propeller blades 82 attached to the propeller boss 90.

The propeller boss 90 has an inner sleeve 94 and an outer sleeve 96 with which the propeller blades 82 are integrally formed. A plurality of radial ribs 98 extend between the inner sleeve 94 and the outer sleeve 96 to support the outer sleeve 96 about the inner sleeve 94 and to form a passage through the propeller boss 90. This passage communicates with an exhaust system of the outboard motor 10 to discharge exhaust gases from the engine, as known in the art.

As best understood from FIG. 1, the exhaust system expels engine exhaust from an exhaust manifold of the engine 18. An exhaust manifold of the engine 18 communicates with an exhaust conduit formed within an exhaust guide 100 positioned at the upper end of the drive shaft housing 38. The exhaust conduit of the exhaust guide 100 opens into an expansion chamber 102. The expansion chamber 102 is formed within the drive shaft housing 38. As seen in FIG. 2, the expansion chamber 102 communicates with a discharge conduit 103 formed within the drive shaft housing 38 and the lower unit 40 that communicates with the discharge passages formed within the propeller boss 90. In this manner engine exhaust is discharged through the hub of the propeller 80 to a region of reduced pressure behind the propulsion device 80, as known in the art.

A conventional steering shaft assembly 104 is affixed to the drive shaft housing 38 by upper and lower brackets. The brackets support the shaft assembly 104 for steering movement. Steering movement occurs about a generally vertical steering axis which extends through the steering shaft of the steering shaft assembly 104. A steering arm 106 which is connected to an upper end of the steering shaft can extend in a forward direction for manual steering of the outboard drive 10, as known in the art.

The steering shaft assembly 104 also is pivotably connected to a clamping bracket 108 by a pin 110. The clamping bracket 108, in turn, is configured to attach to the transom 12 of the watercraft 14. This conventional coupling permits the outboard motor 10 to be pivoted relative to the pin 110 to permit adjustment of the trim position of the outboard motor 10 and for tilt up of the outboard motor 10.

Although not illustrated, it is understood that a conventional hydraulic tilt and trim cylinder assembly, as well as a conventional hydraulic steering cylinder assembly, can be used as well with the present outboard motor 10. The construction of the steering and trim mechanism is considered to be conventional, and for that reason further description is not believed necessary for appreciation or understanding of the present invention.

Figure 3:
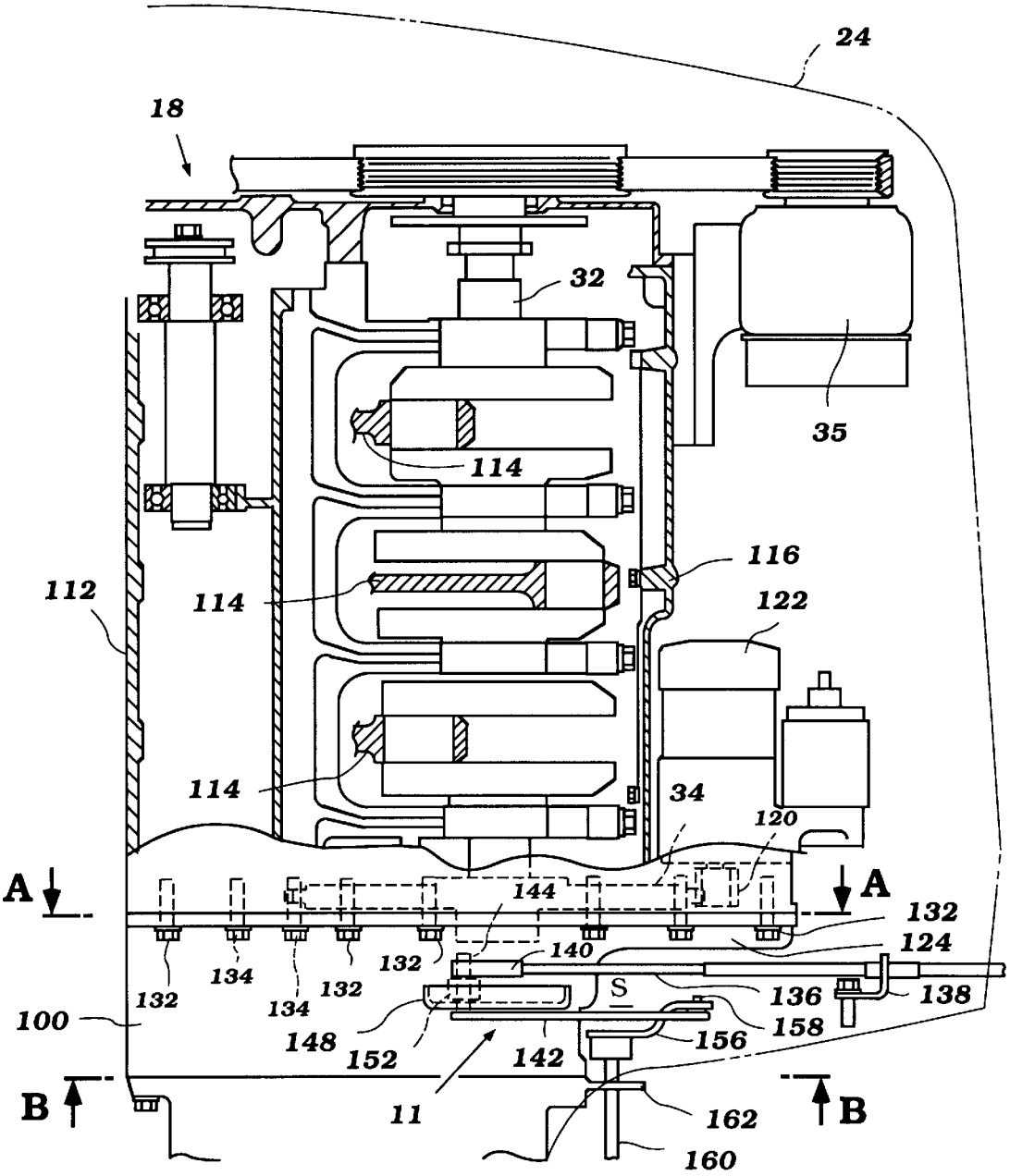
FIG. 3 is a partial, cross-sectional view of a portion of the engine and the associated shifting mechanism of FIG. 1.

With reference to FIG. 3, the engine 18 includes a cylinder block 112, which in the illustrated embodiment defines multiple in-line cylinder bores. Pistons (not shown) reciprocate within the cylinder bores, and connecting rods 114 link the pistons to the crankshaft 32 so that reciprocal linear movement of the pistons within the cylinder bores rotate the crankshaft 32 in a known manner.

A crankcase member 116 is attached to the cylinder block 112 and surrounds at least a portion of the crankshaft 32. The crankshaft 32 is journaled within a crankcase chamber, which is formed by the crankcase member 116 and a portion of the cylinder block 112, so as to rotate about the generally vertical axis.

On the opposite end of the cylinder block 112, as best seen in FIG. 1, a cylinder head 118 is attached to close an end of the cylinder bores. The cylinder head 118 generally has a conventional construction and supports a plurality of intake and exhaust valves. The cylinder head 118 also journals and houses at least one camshaft, which operates the valves.

The valve operation mechanism can be any of a variety of conventional mechanisms. For instance, the overhead camshaft can actuate rocker arms journaled about a rocker shaft to operate the valves within the cylinder head assembly 118. Alternatively, a plurality of overhead camshafts (e.g., intake and exhaust camshafts) can operate the valves directly using tappets, or can be located to the side of the cylinders to operate the valves via push rods, as known in the art. Because the present invention deals primarily with the construction of the throttle linkage system, it is believed unnecessary to provide further description of the particular valve operating mechanism beyond that provided above.

An intake manifold forms a portion of the cylinder head assembly 118. The intake manifold includes a plurality of runners. Each individual runner communicates with an individual combustion chamber of the engine 18 through the intake valve system (not shown).

The timing belt extends between the crankcase pulley and a pulley coupled to the camshaft. As known in the art, the pulley has a diameter twice that of the pulley of the crankshaft, so that the crankshaft 32 drives a camshaft at half the rotational speed of the crankshaft. Although not shown, an upper cover covers the external belt and pulleys.

The engine 18 also includes an induction system. An intake silencer of the induction system is disposed to the front side of the power head 16 and on one side of the crankcase member 116. The intake silencer draws air into the engine 18 through at least one air inlet from the interior of the cowling 20 and silences the intake air charge.

At least one induction pipe delivers air from the intake silencer to at least one charge former. The charge former produces a charge of air and fuel which is delivered to the plurality of runners of the intake manifold. The engine desirably includes a plurality of vertically aligned carburetors, each connected to one of the induction pipes. It should be understood, however, that although the invention is described in conjunction with a carbureted engine, the invention may be employed in connection with other types of charge formers, such as fuel injectors or the like.

As seen in FIG. 3, the flywheel assembly 34 is secured to a lower section of the crankshaft 32 by known means. At this position, the flywheel 34 lies near a lower end of the engine 18 at a location outside the crankcase chamber. In the illustrated embodiment, the flywheel assembly 34 is positioned within a recess formed at the lower end of the engine 18.

A pinion 120 cooperates with a large ring gear formed on the periphery of the flywheel 34. A starter motor 122 drives the pinion 120 in a known manner. In the illustrated embodiment, the starter motor 122 is located in the engine 18 on the front side of the crankcase member 116 and at a level above the flywheel 34. In the position, the starter motor 122 lies within the space below the alternator 35 for a compact layout of these engine components.

Figure 4:
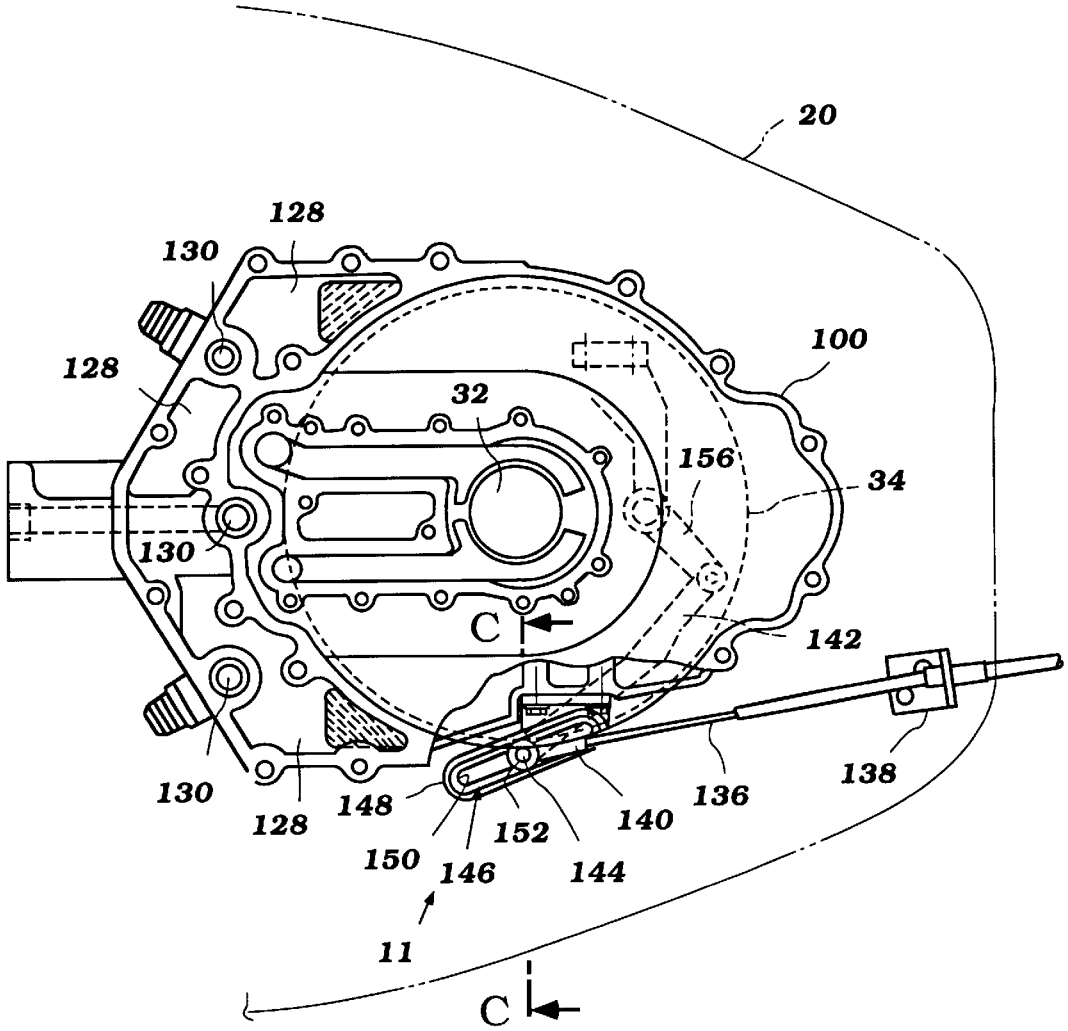
FIG. 4 is a top plan view of the engine and the shifting mechanism as viewed in the direction A—A of FIG. 3.
Figure 5:
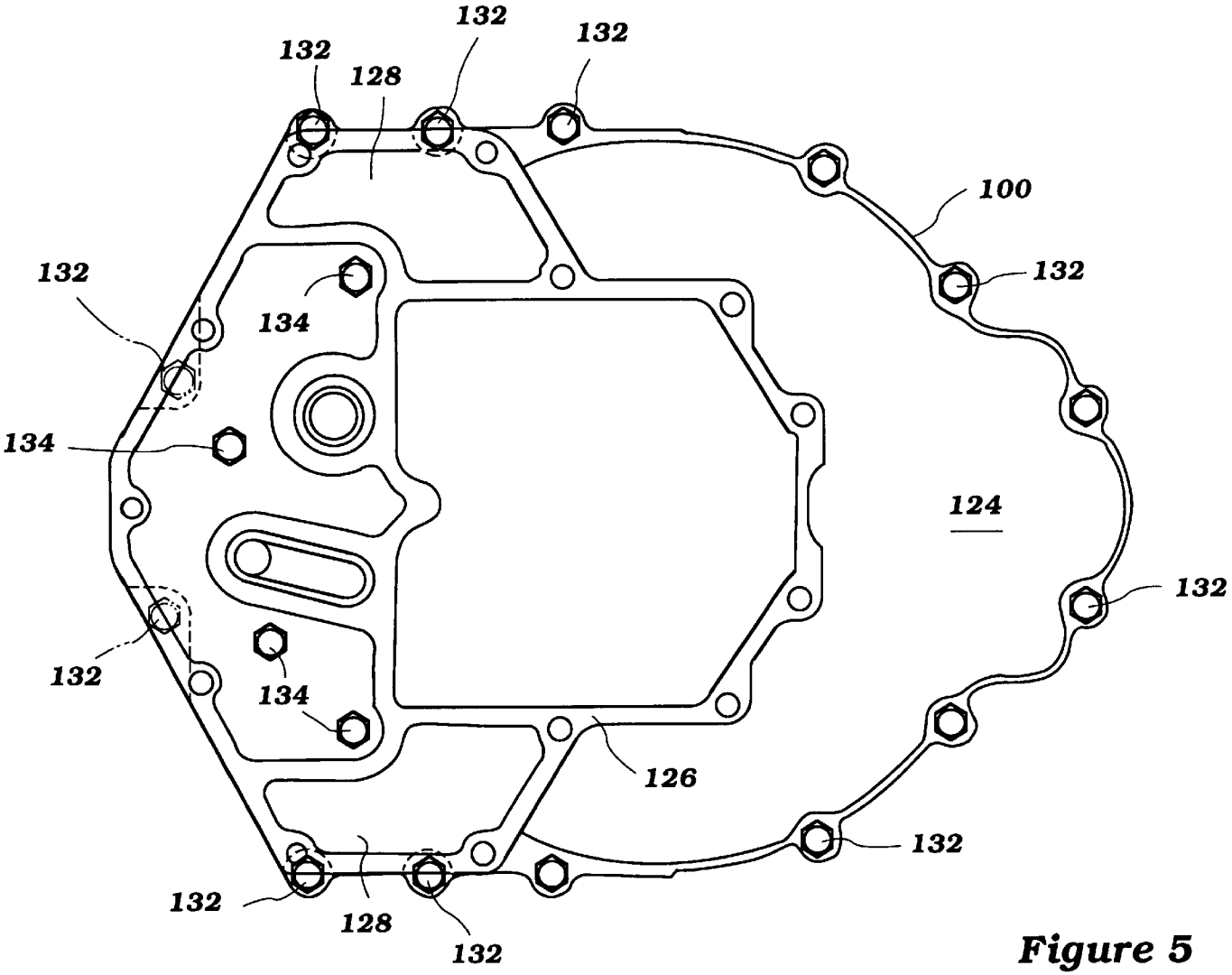
FIG. 5 is an enlarged, isolated bottom plan view of an exhaust guide which is attached to the engine as viewed in the direction B—B of FIG. 3.

As best seen in FIGS. 3 through 5, the exhaust guide 100 is secured to the lower end of the engine 18. The upper end of the exhaust guide 100 cooperates with the engine lower end to enclose the flywheel 34 within the recess.

The front end of the exhaust guide 100 includes a plate-like section 124 that covers the lower end of the engine 18. As best seen in FIG. 5, the plate 124 projects about a front half of a main body 126 of the exhaust guide 100 to cover the lower end of the engine 18 at this location. The overhang of the plate 124 in front and to the sides of the main body 126 defines recessed section S (see FIG. 3) of the exhaust guide 100 below the lower end of the engine 100.

With reference to FIGS. 4 and 5, the main body 126 of the exhaust guide 100 includes a plurality of oil passages 128 which place an oil pan in communication with an oil pump, oil galleries and the crankcase of the engine 18. The exhaust guide 100 also includes a plurality of coolant passages 130 with cooperate with a coolant system of the outboard motor 10. These passages lie to the sides and behind the exhaust passage that communicates with the expansion chamber 102 of the exhaust system.

The exhaust guide 100 also includes a plurality of through holes positioned about its periphery, as well as arranged within its interior. The through holes cooperate with periphery bolts 132 and inner bolts 134 that cooperate with threaded holes on the lower end of the engine 18 to secure the exhaust guide 100 to the engine 18. The inner bolts 134 compress the interior of the exhaust guide 100 against the lower end of the engine 18 to improve the seal between exhaust guide 100 and the engine lower end. This improved seal inhibits any cross flow of fluids between the passages of the exhaust guide 100.

With reference to FIGS. 3, 4, 6 and 7, the shifting mechanism 11 controls the transmission actuator 60 in order to vary the drive conditions of the outboard motor 10. The shifting mechanism 11 cooperates with a remotely located shift operator (not shown) that controls the shifting mechanism 11. In an exemplary embodiment, the remote shift operator is located on the steering arm 106 of the outboard motor 10; however, the remote shift operator also can lie either in the hull of the watercraft 14 or within or adjacent to the power head 16 of the outboard motor 10.

A bowden-wire-type shift cable 136 desirably couples the remote shift operator to the shifting mechanism 11. In the illustrated embodiment, a bracket 138, which is mounted within the cowling assembly 20, supports a portion of the cable 136 near the shifting mechanism 11 and prevents movement of an outer casing of the cable 136 relative to the cowling 20.

In the illustrated embodiment the shifting mechanism 11 includes a fitting 140 positioned at the end of the shift cable 136. The fitting 140 is coupled to an end of a link 142. A pivot pin 144 of the shifting mechanism 11 interconnects the cable fitting 140 and the link 142 in order to permit relative rotational movement between these components.

Figure 7:
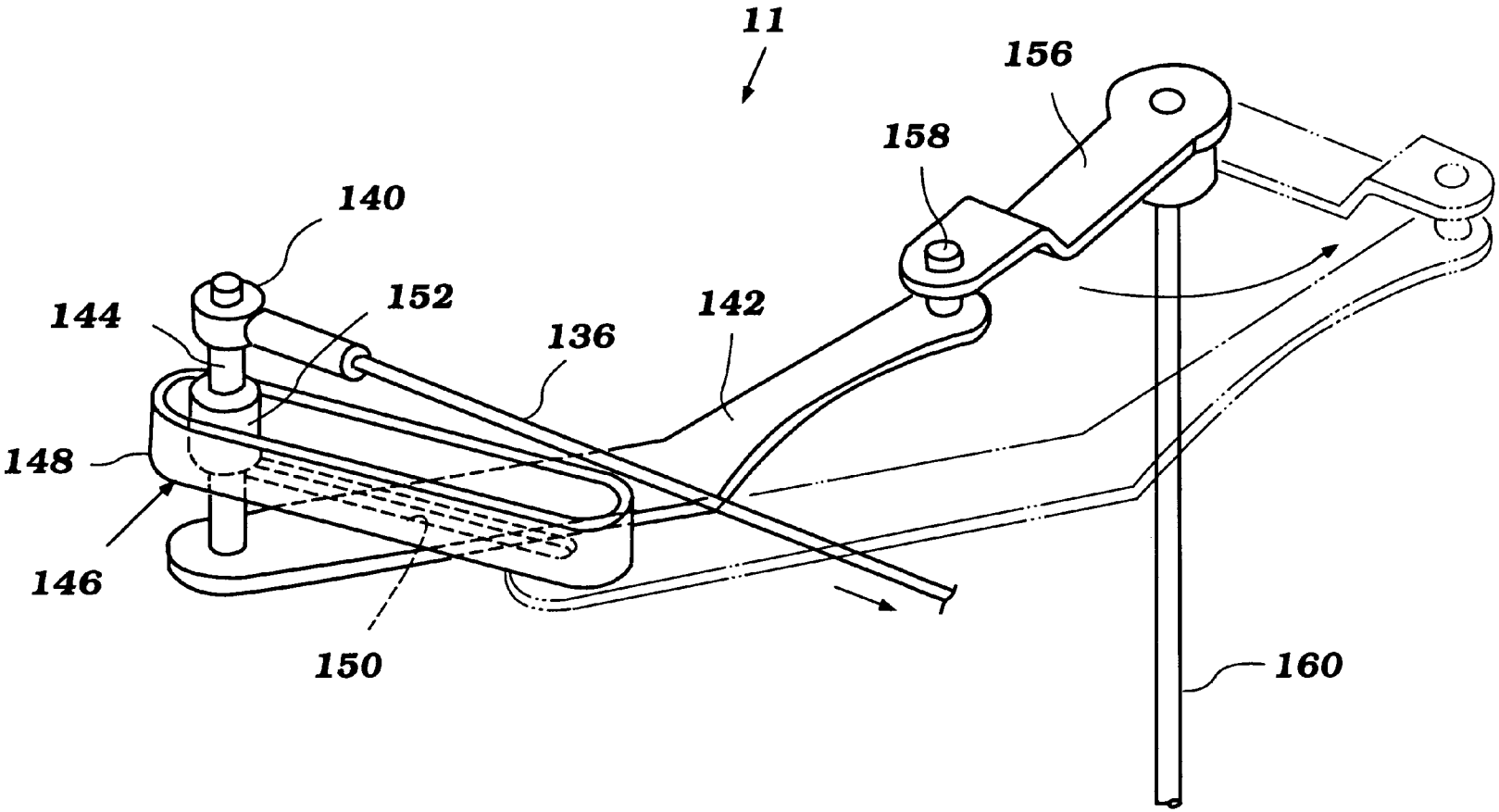
FIG. 7 is a perspective view of the shift mechanism of FIG. 1 in isolation.

A guide mechanism 146 of the shifting mechanism 11 supports the pivoted coupling between the cable fitting 140 and the link 142. As best seen in FIGS. 4 and 7, the guide mechanism 146 includes a cam member 148 that defines a slot or cam groove 150. In the illustrated embodiment, the groove 150 is straight; however, in some applications, the groove can have a slightly arcuate shape which curves away from the engine 18. A roller 152 supports and journals the pivot pin 144 within groove 150.

As best seen in FIG. 6, a bracket 154 supports the guide mechanism 146 below the engine lower end and generally beneath at least a portion of the flywheel's peripheral edge. The guide mechanism 146 thus lies in a space P formed between the lower tray 22 of the cowling assembly 20, the plate 124 of the exhaust guide and the exhaust guide body 126 in order to reduce the girth of the engine 18. This location also protects the guide mechanism 146 and the link 142, while allowing the guide mechanism 146 to be accessible without substantial disassembly of the engine 18.

With reference to FIGS. 4 and 7, an opposite end of the link 142 is connected to an end of a shift control lever 156. A pivot pin 158 couples together the ends of the link 142 and the lever 156 to allow relative rotational movement between these components of the shifting mechanism linkage.

In the illustrated embodiment, as seen in FIG. 7, the shift lever 156 has a vertical jog. A portion of the lever thus lies below the end coupled to the lever 142.

A shift control rod 160 is fixed to the lower portion of the shift lever 156. As seen in FIG. 3, a boss 162 formed on the exterior of the oil pan supports the upper end of the shift control rod 160.

The shift control lever 156 thus is coupled to an upper end of the upper shift control rod 160. As understood from FIG. 1, the shift control rod 160 depends from the power head 16, desirably from a location beneath the flywheel 34. A lower shift control rod 164 is splined to the lower end of the upper shift control rod 160 and depends into the lower unit 40 to a point near the transmission 42.

The lower shift control rod operates the transmission actuator to change the drive condition of the transmission 42. In the illustrated embodiment, the cam member 72 of the transmission actuator 60 is integrally formed on the lower end of the lower shift rod 164; however, other couplings between the shift rod and the transmission actuator can be used as well.

As best understood from FIG. 4, both the link 142 and the shift control lever 156 are arranged and operate directly beneath the flywheel 34 within the recessed section of the exhaust guide. This location of the linkage of the shifting mechanism 11 produces a compact arrangement of the shifting mechanism 11 within the cowling assembly 20. This location also protects the linkage, while allowing access to the control lever 156, shift rod 160 and link 142 without disassembly of the engine 18.

FIG. 7 illustrates the movement of the link 142 and lever 156 between the reverse position and the forward position (shown in phantom). Movement of the cable fitting 136 toward the forward position forces the attached end of the link 142 in the forward direction. The link 142 and the coupled shift lever 156 consequently move forward about the illustrated arc. This movement causes the shift lever 156 to rotate about the axis of the shift control rod 160, which in turn causes the shift control rod 160 to rotate about its own axis to actuate the transmission 42. The operation of the shifting mechanism 11 when disengaging the transmission 42 (i.e., establishing a neutral drive condition) as well as when engaging the transmission 42 under a reverse drive condition is substantially identical to that described above, except that the components of the shifting mechanism 11 move and rotate in a direction opposite to that described above.

Figure 8:
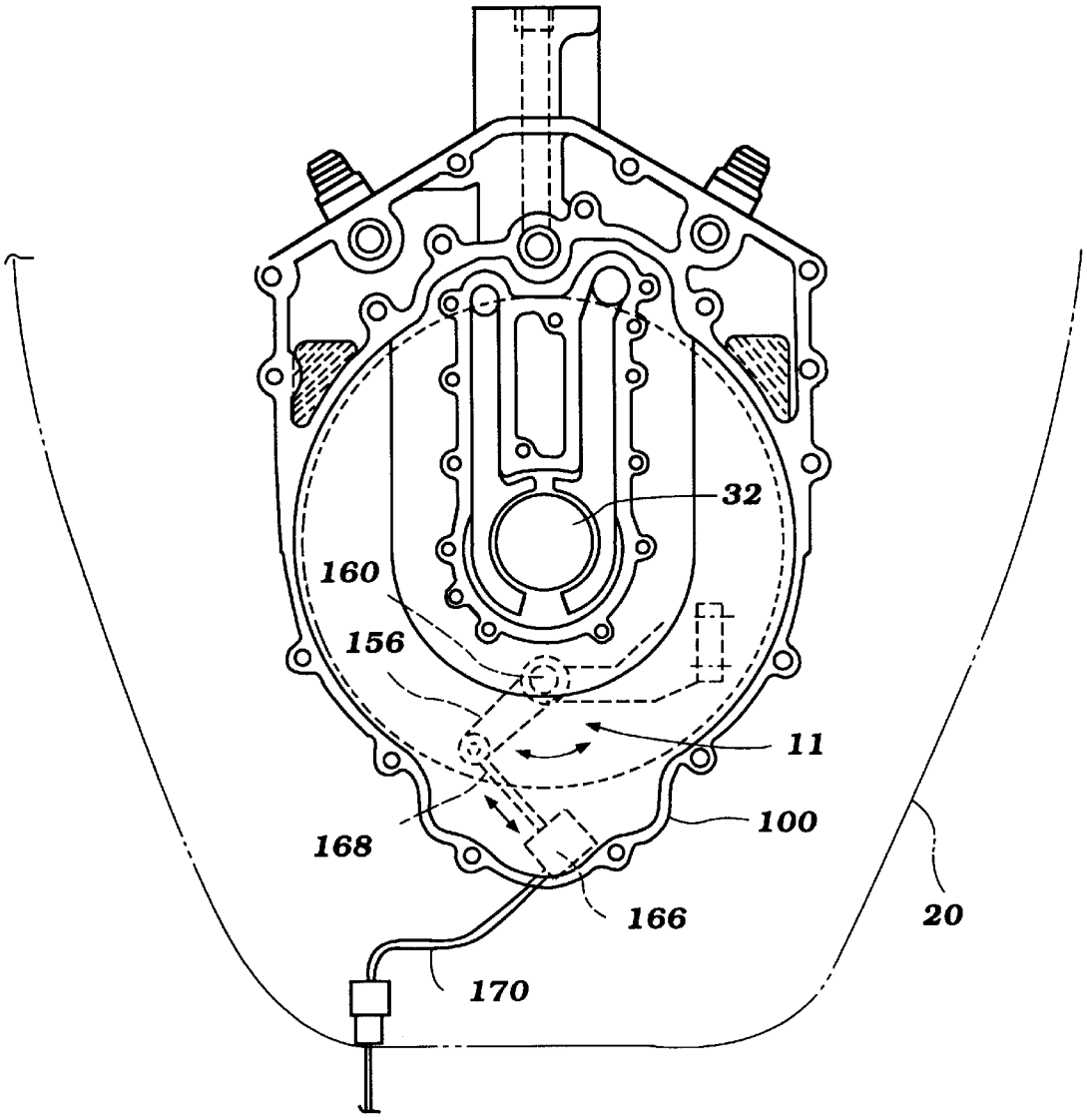
FIG. 8 is a top plan view of an engine and shift mechanism, viewed in a direction similar to that illustrated in FIG. 4 and configured in accordance with another preferred embodiment of the present invention.

FIG. 8 illustrates another embodiment of the shifting mechanism in which the mechanical shift operator of the shifting mechanism is replaced by an electric actuator 166. The following description of this embodiment will use like reference numerals to the above described embodiment in order to ease the reader's understanding.

As seen in FIG. 8, the actuator 166 is positioned below the exhaust guide 100 in the recessed section of the exhaust guide 100. An extendable arm 168 of the actuator 166 is connected to the outer end of the shift lever 156. The shift lever 156 lies beneath the flywheel 34.

An electrical cable 170 connects the actuator 166 to the remote shift operator. Like the above described embodiment, the remote operator can be positioned on the steering handle 106 of the outboard motor 10 or at a location within the watercraft 14. Movement of the arm 168 toward and away from the actuator 166 causes the shift lever 156 to rotate, as illustrated in FIG. 8.

The opposite end of the shift lever 156 is coupled to a shift rod 160. Rotation of the shift lever 156 rotates the shift rod 160 by an equal degree. The shift rod 160 communicates this rotational movement to a transmission actuator 60 to operate the transmission 42 in the manner described above.

As common to the above-described embodiment, the shifting mechanism 11 principally lies at a level below the flywheel 32 and desirably lies at least in part directly beneath the flywheel 34 in order to present a compact arrangement of the shifting mechanism within the cowling assembly 20. The location of the shift operators of the shifting mechanism also beneath the exhaust guide further reduces the cowling size while allowing these devices to be readily accessible for servicing and repair.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. An outboard motor comprising a cowling and an engine including an output shaft which rotates about a vertical-extending axis and a flywheel carried on a lower section of the output shaft at a lower end of the engine, the engine being housed within the cowling, the output shaft driving a propulsion device through a transmission which is intended to operate under at least two operational conditions, a transmission actuator cooperating with the transmission to selectively establish one of said at least two operational conditions of the transmission, and a shifting mechanism controlling the transmission actuator and including an input element which is adapted to interact with and to operate between a remote operator and a shift control rod of the shifting mechanism, said input element of the shifting mechanism being positioned within the cowling and entirely below the level of the flywheel, said input element being axially movable along an axis and being coupled to the shift control rod so as to rotate the shift control rod when moved axially.

2. An outboard motor as in claim 1, wherein the input element of the shifting mechanism lies at least partially beneath the flywheel.

3. An outboard motor as in claim 2, wherein a linkage of the shifting mechanism is positioned beneath the flywheel.

4. An outboard motor as in claim 1, wherein the shift mechanism includes a guide mechanism.

5. An outboard motor as in claim 4, wherein the guide mechanism lies near a peripheral edge of the flywheel.

6. An outboard motor as in claim 4, wherein said guide mechanism lies at least partially beneath the flywheel.

7. An outboard motor as in claim 1, wherein the shift mechanism includes an electric actuator.

8. An outboard motor as in claim 1 additionally comprising an exhaust guide affixed to the lower end of the engine above at least a portion of the shifting mechanism.

9. An outboard motor as in claim 8, wherein the exhaust guide encloses the flywheel within the lower end of the engine.

10. An outboard motor as in claim 9, wherein a first plurality of bolts secure the periphery of the exhaust guide to the lower end of the engine, and a second plurality of bolts are positioned within the periphery of the exhaust guide and force an inner section of the exhaust guide against the lower end of the engine.

11. An outboard motor as in claim 8, wherein at least part of the shifting mechanism lies at least partially beneath the exhaust guide within a recessed section of the exhaust guide.

12. An outboard motor as in claim 1, wherein the shift control rod couples the input element of the shifting mechanism and the transmission actuator.

13. An outboard motor as in claim 12, wherein the shift control rod extends along a vertically-extending axis and is positioned beneath the flywheel.

14. An outboard motor as in claim 1 additionally comprising a starter positioned at a level above the flywheel.

15. An outboard motor as in claim 14, wherein the starter is positioned at an end of a crankcase member of the engine.

16. An outboard motor as in claim 1, wherein the input element is coupled to a shift cable at a position below the level of the flywheel.

17. An outboard motor as in claim 16, wherein the input element comprises a fitting and a pivot pin that are rotatably interconnected.

18. An outboard motor comprising an engine housed within a cowling, an output shaft of the engine extending from at least a lower end of the engine and arranged to rotate about a vertically-extending axis, a flywheel mounted to the output shaft at the lower end of the engine, a drive shaft being coupled to the output shaft and driving a propulsion device of the outboard motor through a transmission which establishes at least two drive conditions for the propulsion device, a transmission actuator cooperating with the transmission to selectively establish one of said at least two drive conditions, means for operating the transmission actuator, and an input element for said means for operating the transmission actuator that is remotely located relative to the transmission actuator in a position lying entirely below the flywheel within the cowling, said input element being directly coupled to a shift cable.

19. An outboard motor as in claim 18, wherein the means for operating the transmission actuator is housed within the cowling.

20. An outboard motor as in claim 18 additionally comprising a shift rod interconnecting the transmission actuator and the means for operating the transmission actuator.

21. An outboard motor as in claim 18, wherein the means for operating the transmission actuator lies adjacent to and directly below an exhaust guide affixed to the lower end of the engine.

22. An outboard motor as in claim 21, wherein at least a portion of the means for operating the transmission actuator lies within a recessed section of the exhaust guide.

23. An outboard motor comprising a cowling and an engine including an output shaft which rotates about a vertical-extending axis and a flywheel carried on a lower section of the output shaft at a lower end of the engine, the output shaft driving a propulsion device through a transmission which is intended to operate under at least two operational conditions, a transmission actuator cooperating with the transmission to selectively establish one of said at least two operational conditions of the transmission, and a shifting mechanism controlling the transmission actuator and includes an input element which is adapted to interact with and to operate between a remote operator and a shift control rod of the shifting mechanism, said input element of the shifting mechanism being positioned within the cowling and entirely below the level of the flywheel, said input element being movable relative to an axis that is generally normal to the vertically extending axis.

24. An outboard motor as in claim 23, wherein the input element lies at least partially beneath the flywheel.

25. An outboard motor as in claim 24, wherein a linkage of the shifting mechanism is positioned beneath the flywheel.

26. An outboard motor as in claim 23, wherein the input element comprises a fitting and a pivot pin rotatably interconnected.

27. An outboard motor as in claim 23, wherein the input element is coupled to a shift cable at a position below the flywheel.

28. An outboard motor as in claim 23, wherein the shifting mechanism includes an electronic actuator.

29. An outboard motor as in claim 23, wherein the shifting mechanism includes a guide mechanism that cooperates with the input element, and the guide mechanism lies at least partially beneath the flywheel.

30. An outboard motor as in claim 23 additionally comprising an exhaust guide affixed to the lower end of the engine above at least a portion of the shifting mechanism and enclosing the flywheel within the lower end of the engine.

31. An outboard motor as in claim 30, wherein the exhaust guide includes a recessed section in which at least a portion of the shifting mechanism is arranged.

32. An outboard motor as in claim 23 additionally comprising a starter positioned at a level above the flywheel.

* * * * *